US006107558A

United States Patent [19]

Cowan

[11] Patent Number: 6,107,558

[45] Date of Patent: Aug. 22, 2000

[54] UNIVERSAL SEMI-AUTOMATIC HAND-PORTABLE PAGE-CHANGER

[76] Inventor: William W. Cowan, 1951 (#159) 47$^{th}$St., San Diego, Calif. 92102

[21] Appl. No.: 09/251,782

[22] Filed: Feb. 17, 1999

[51] Int. Cl.$^{7}$ ..... G10G 7/00

[52] U.S. Cl. ..... 84/488; 84/486; 84/487

[58] Field of Search ..... 84/487, 486, 488, 84/495, 500, 508, 520, 517

[56] References Cited

U.S. PATENT DOCUMENTS

| | | | |
|---|---|---|---|
| 614,372 | 11/1898 | Ramur | 84/488 |
| 2,484,106 | 10/1949 | Mallina | 40/104 |
| 3,570,154 | 3/1971 | Cosenza | 40/35 |
| 3,608,420 | 9/1971 | Hazeleh . | |
| 3,665,093 | 5/1972 | Machnacz | 84/487 |
| 3,732,773 | 5/1973 | Bombardi | 84/491 |
| 3,939,587 | 2/1976 | Weststrom | 40/104 |
| 4,031,644 | 6/1977 | Rogers | 40/104 |
| 4,072,080 | 2/1978 | Conlin | 84/486 |
| 4,545,141 | 10/1985 | Ito | 40/531 |
| 4,644,675 | 2/1987 | Berger | 40/531 |
| 4,719,712 | 1/1988 | Moreau | 40/475 |
| 4,936,034 | 6/1990 | Chen | 40/531 |
| 5,052,266 | 10/1991 | Burster | 84/493 |
| 5,203,248 | 4/1993 | Carr | 84/487 |
| 5,247,755 | 9/1993 | Sato | 40/476 |

OTHER PUBLICATIONS

Applicant Filed a PTO/Disclosure–document on an earlier Page–changer Prototyped Apparatus #396,261 Filed: Apr. 15, 1996 see copy in I.D.S. herewith.

*Primary Examiner*—Bentsu Ro
*Assistant Examiner*—Shih-Yung Hsieh
*Attorney, Agent, or Firm*—Inventech/USA

[57] ABSTRACT

The notion of a reliable semi-automatic page-changer apparatus has heretofore been elusive to inventors, however with the event of a major new handling technique, a practical solution is herein introduced. Predicated upon the principle of establishing a modular standard for the viewed paper, facilitating either sheet-music for musicians or text-pages for speakers. This involves generally utilizing the US/8½× 11-inch format, or the european A4/29.7×21 cm format, whereby any pre-existing graphic-copy can be readily and economically transferred thereto via convenient photocopy machine process and via a special hangeer-hole device, overcoming the usual disfunctional predisposition toward inter-clinging of the stacked pages. Generally using a foot-operated sequencing-switch, the instant page is transferred via a novel spindle-conveyer to a holding-stack; enabling viewing of consecutive pages either at their originating elevated position or at their final landing position there below. When a performance is completed, the resultingly reverse-sequenced stack of viewed-pages can be automatically rearranged rapidly to their desired original sequence, via an automatic-reshuffler mode of operation.

20 Claims, 1 Drawing Sheet

UNIVERSAL SEMI-AUTOMATIC HAND-PORTABLE PAGE-CHANGER

I.) BACKGROUND OF RELEVANT EARLIER INVENTION:

Field of Invention

This invention generally relates to so-called automatic page-turning apparatus, and more specifically it relates to those types of devices which may be deployed upon a music-stand or piano's shelf as to operate in a manner transfering individual sheets of stacked paper sequentially in a vertical gravity-transfering manner.

Heretofore, it has largely been the practice for some designers of sheet-music handling apparatus to try to adapt the mechanism involved to fit the format of either sheet-music or a music-book, principally involving the notion of over-turning pages 180-degrees in some manner generally from right-to-left.

Background research discovery provides some prior patent-art, which are however impractical regarded as at least remotely germane to this disclosure, chronologically for example U.S. Pat. No. 2,484,06 (filed: April 1946) shows use of a motorized windlass or rotary-drum made to reel a thread in, to which has been pre-attached at regular spaced intervals a plurality of individual conventional paper-clips. The different pages of a music-book are thus turned across right-to-left, as the left situated drum is turned reeling-in the thread, the paper-clips becoming pulled-off of each succeeding page.

In U.S. Pat. No. 3,570,154 (filed: December 1968) is shown an electric page-turning apparatus employing a swingarm having a magnetic attractor-element which deploys against ferrous-clips necessarily attached to succeeding pages of a music-book for example; while a remote-switch can be foot-operated to actuate every page turning sequence.

In U.S. Pat. No. 3,608,420 (filed: June 1969) shows a manual page-turning apparatus employing a plurality of individual vertical stay-rods swinging outset from the swing-axis arranged along the spine of the exemplified music-book. A stay-rod is necessarily pre-positioned between each succeeding page of the book, while a manually operated rotary-arm arranged coaxially with the swing-axis, causes each page to be flipped-over as desired.

U.S. Pat. No. 3,665,093 (filed: September 1970) contemplates the use of an electric-motor upon which axis is fitted a simple driver/cord-pulley, in cooperation with a laterally spaced apart second cord/idler-pulley. Also included is a parallel guide-wire, whereby page-clips affixed both to the continuously traversing pulley-cord and to the stabilizing guide-wire, act to draw pages successively from right-to-left upon activation of the motor. The apparatus is mounted upon a podium, and a remote-control motor foot/actuation-switch is included, enabling the musician to keep their hands free to play their musical-instrument.

In U.S. Pat. No. 3,732,773 (filed: September 1971) another page-turning apparatus is shown employing a complex array of individual interstitially pre-positioned page-turning swingarms serving to flip-over pages 180-degrees as desired.

In U.S. Pat. No. 3,939,587 (filed: February 1974) is described an electric pager-turning apparatus employing a transversely actuated rubber-roller, which translates right-to-left across successive pages of an open book; and includes a transparent cover-panel acting to hold the pages substantially flat in place for viewing. Relatively cumbersome physically, the machine is designed primarily for handicap persons.

In U.S. Pat. No. 4,031,644 (filed: April 1976) is shown a simple electrically powered page-turning apparatus for a book laying horizontally upon it's spine, comprising a swingarm aligned parallel with the spine of a music-book. The swingarm having a friction-wheel arranged coaxially thereto, which initially scuffs open a succeeding page; whereupon a radially extending gravity dependent scuffing-finger acts to finally flip-over the initially raised page.

In U.S. Pat. No. 4,072,080 (filed: February 1976) is shown a special standing-rack for holding sheet-music, the vertical-axis of the rack includes a plurality of concentric-sleeves which are each selectively rotated one at a time, each sleeve thereby successively turning a given horizontally disposed swingarm supporting a page of sheet-music; including a foot-operated sequencing-switch.

In U.S. Pat. No. 4,644,675 (filed: February 1985) shows a music-book page-turning apparatus employing a flat-disk which lays centrally across the upper-seam between two adjoining pages; the electric-motor driven disk having a radial-finger portion, rotates under a page when an adjoining friction-wheel creates a raised-curl of the right-hand page. When the flat-finger has rotated under the next successive page, it's continued clockwise-rotation enables it to actually flip-over the page; however, the friction-roller tends to obscure a portion of the upper/right-hand page.

In U.S. Pat. No. 4,719,712 (filed: October 1984 via France) is shown a piano-shelf mountable music-book page-turning apparatus, wherein is proposed either a suction-tube page-lifting method, an electrostatic page-lifting method, or a friction-wheel method having either triangular or polygonal cross-section as a means of attaining a raised-curl to the page. Any of the three methods thus offering a means by which to lift the right-hand page of a music-book, whereupon the carriage supporting the lifting-device translates transversely from right-to-left until the page is said to be effectively flipped-over as it were.

In U.S. Pat. No. 4,936,034 (filed: April 1989) shows a book page-turning apparatus having two rotary-arms arranged at the upper end of a book's spine, so that one arm acts to stay the left-hand page, while the other arm acts (such as via suction lifting means) to swing the succeeding page from right-to-left.

In U.S. Pat. No. 4,545,141 (filed: September 1984 to NCR-corp.) is shown an "automatic document page turning apparatus" employing a page-turning roller in co-action with a page-lifting roller-wheel which acts to turn-over individual pages of a music-book for example.

In U.S. Pat. No. 5,052,266 (filed: April 1990) is shown a page-turning apparatus comprising a support-stand and a plurality of page-like panels into which opposite sides are pre-attached in desired order the music-sheets. A foot-powered teleflex-cable driving mechanism serves to sequence the 180-degree page-turning action.

In U.S. Pat. No. 5,203,248 (filed: February 1992) shows a page-turning apparatus such as for turning pages of sheet-music via individual tabs clipped to each sheet. The tabs are coupled to an endless-belt member driven by an electric-motor, which is said to draw the tabs from right-to-left upon command of a foot-switch.

In U.S. Pat. No. 5,247,755 (filed: January 1991) shows a page-turning apparatus for a camera-copier system, wherein a rotary/suction-head is applied to a page, and is then transulated transversely across from right-to-left to effect a 180-degree page-turn sequence.

Therefore, in full consideration of the preceding patent review, there is determined a need for an improved form of device to which these patents have been largely addressed. The instant inventor hereof believes their greatly simplified page-sequencing or page-changer apparatus, commercially referred to as the PAGEMINDER™, currently being developed for production under the auspices of Cowan-Mfg./Mkt.Co., exhibits certain advantages over page-turning apparatus, as shall be revealed and systematically set forth in the subsequent portion of this instant disclosure.

II.) SUMMARY OF THE INVENTION

A.) In view of the foregoing discussion about the earlier invention art, it is therefore important to make it pellucid to others interested in the art that the object of this invention is to provide a "universal" page-sequencing apparatus not necessarily based upon need to employ any uniform or standardized format of sheet-music (or other printed material, perhaps for reading a speech at a podium);—such as for example may handle both the popular USA/8½"×11", even in mixed (interspersed) combination with the European standardized A4/21 cm×29.7 cm sized page format (proportionally slightly narrower and longer). By virtue of adopting a uniform top-center approximate ¼-inch hole-punch, method of hanging my pages, it has been found that a mechanism can be implemented which need not actually execute a page-turning procedure, but rather more preferably a vertical gravity-feed page-transfering procedure. Thus, while it is preferred that the sheetmusic be uniformly photocopied upon a standard-size sheet of 24-lb. paper, just to make the whole stack more attractive and neat to work with, my invention is universally capable of handling mixed page sizes; necessarily having in common only the single central header-margin hanger-hole.

The vital notion of a simple uniform format employing a single central hanger-hole has conceptually eluded previous inventors endeavoring to provide a reliable, inexpensive, convenient to use apparatus, which initially receives an orderly stacked sequence of individually loose pages. The music-score/lyrics pages are thus initially photocopied from an original music-book or other source, upon one side of a page only,—next, the loose-leaf pages are hole-punched at the top-center, whereupon standard O-shaped punched-hole reinforcement-groments may also be installed for greater durability if desired; then merely stacked in numbered sequence, from page-one on top through to the last-page at the bottom (or back of the stack). This stack is then simply placed upon a screw-threaded hanger-pin refered to herein as the conveyor-spindle device protruding perpendicularly from the uppermost guide-surface of the back-support whereby upon rotation of the spindle, pages are sequenced to transfer outward from the base of the spindle outward upon forward rotation at any rate of timing desired, by the observing musician. The rotary-worm like conveyer-spindle principle of operation uniquely obviates the clutter of complex prior-art apparatus, by virtue of an elegantly simple spiral helix only remotely akin to the Archimedes-screw (in 200 bc-Greece, a inclined deeply-threaded screw encased intimately within tube, and capable of lifting water when axially rotated).

B.) Another object of this invention disclosure is to set forth a sheet-music page-sequencing apparatus, wherein is provided a preferably hand-portable folding transparent-plastic case, optionally comprising a set of inner-nesting upper/lower tray portions preferably arranged as to either hinge or slide together into a compact stow-modality (providing a more convenient hand-portable modality), while capable of holding a full performance-ready program of collated sheetmusic, which may involve some two to four dozen pages or more. The upper portion of the case also serves to house a commercially available battery-powered electric-motor (preferred over the alternate option of a conventional wind-up powered spring-wound clock-work motor mechanism, such as is commonly employed in music-box devices including a ratio-reduction drive adapted to turn the conveyor-spindle at a slower rate that the primary spring motor's full rate of rotation) with integral gear-reduction driven sequencing-mechanism providing semi-automatic page changing;—that is, changing of a read page according to user urging, via closing of a normally-open actuating momentary-switch generally situated at the lower front of the case;—or, via an optional plug-in corded-jack connecting the apparatus with a preferred remote footswitch, thereby leaving a musician's hands entirely free to attend to their musical-instrument. An optional plug-in corded-jack enables the page-sequencer apparatus to be stationed upon the existing music-rack shelf of a piano. In any case, battery-power is preferred over wall power-outlet/115 v.ac, in as much as the spindle-conveyer mechanism demands very little electrical energy to operate intermitently for hours, and the freedom of battery operation, makes the page-sequencer easily employed at any of the individual station positions determined by the orchestra-leader, without stringing of wires to each music-stand.

C.) Another object of this invention disclosure is to set forth a musician's sheetmusic (or orator's speech-pages) page-sequencing apparatus, wherein is provided two modalities of usage;—the first being wherein the back-support is a rigid bracket extending up from an exsiting keyboard music-backrest (be it horizontal or upright piano or organ), whereto the spindle-conveyer device is thereby spaced sufficiently upward therefrom as to enable each dependently hanging page to drop separately downward upon a sheetmusic-rest therebelow, whereto each successive page can be read by the keyboard-player at the music-backrest's normal conventional reading height. The bracket proferably includes a clamping device (such as an inverted U-shaped spring-clamp, or a thumb-screw type clamp), whereby the bracket apparatus does not intruce into the space where the pages land in a cluster therebelow.

The second modality of usage being to arrange the reading observation whilst the page is still upon the conveyer-spindle, and wherein the back-support is formed vertically contiguously with a lower receiver-support portion thereby defining a smooth guide-surface preferably including a right-angle flange like bottom-rest, and an uppermost right-angle flange, plus left and right sidewalls, and also preferably includes a flexible transparent plastic cover spanning top to bottom across between the sidewalls, and which is readily attachable/detatchable, as to prevent wind-blown disruption of the page changing operation during windy or rainy conditions.

D.) Another object of this invention disclosure is to set forth a musician's sheetmusic (or orator's speech-pages) page-sequencing apparatus, wherein is provided a special sequencing-mechanism which coordinated operation functions generally as follows:

a.) INITIAL ONE-TIME PREPARATION:—installing a single hanger-hole (with optional reinforcement-grommet) centered into the header-margin via a conventional manually actuated hole-punch tool (which can be a commercially available handtool, or built-in to the back-support bracket);

b.) STANDBY-SEQUENCE:—wherein the spindle-conveyer of the back-support is supplied with sequentially arranged (face-out, 1st-page showing toward reader/user) sheet-music pages, while below, the shelf of the receiver-support remains empty initially;

c.) ROTARY-SEQUENCER:—user thus initiates operation by pressing a normally off type momentary switch, thereby activating conveyance movement of the outermost page's hanger-hole along the rotary conveyer-spindle from the back-support;

d.) TRANSFERRING-SEQUENCE:—feeding sequentially along the apex of the worm screw-threws of the conveyer-spindle the sequencing outermost page simply drops away via gravity transfer from the conveyer-spindle of the back-support, to be recovered down into the receiver-support, whereupon power is shut-off. Succeeding individual outer-most pages are likewise transferred into the receiver-support upon actuation of the off/on switch (preferably foot-operated), where pages delivered land successively in front of the already read previous outer-page in the receiver-support.

e.) SEMI-AUTOMATIC RECOLLATING:—once the last read page has been transfered, the user may withdraw the completed sheetmusic from the receiver-support below, and by switching the rotation of the spindle-conveyer into reverse, proceed to rehang the reverse-ordered stack (thus now renumbered last-to-first); then once placed upon the spindle-conveyer in unusable reversed order, places the control-switch into Continuous-mode to perform a recollating-sequence, thereby reshuffling the pages to the receiver-support until page-1 once again emerges atop (in front of) the stack. Hence, the stack has been entirely recollated into original usable reading order (numbered front-to-rear first-page to last-page), ready for future use.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

IV.) ITEMIZED NOMENCLATURE REFERENCES

Figures 1A, 1B, 2, 3, 4, 5:
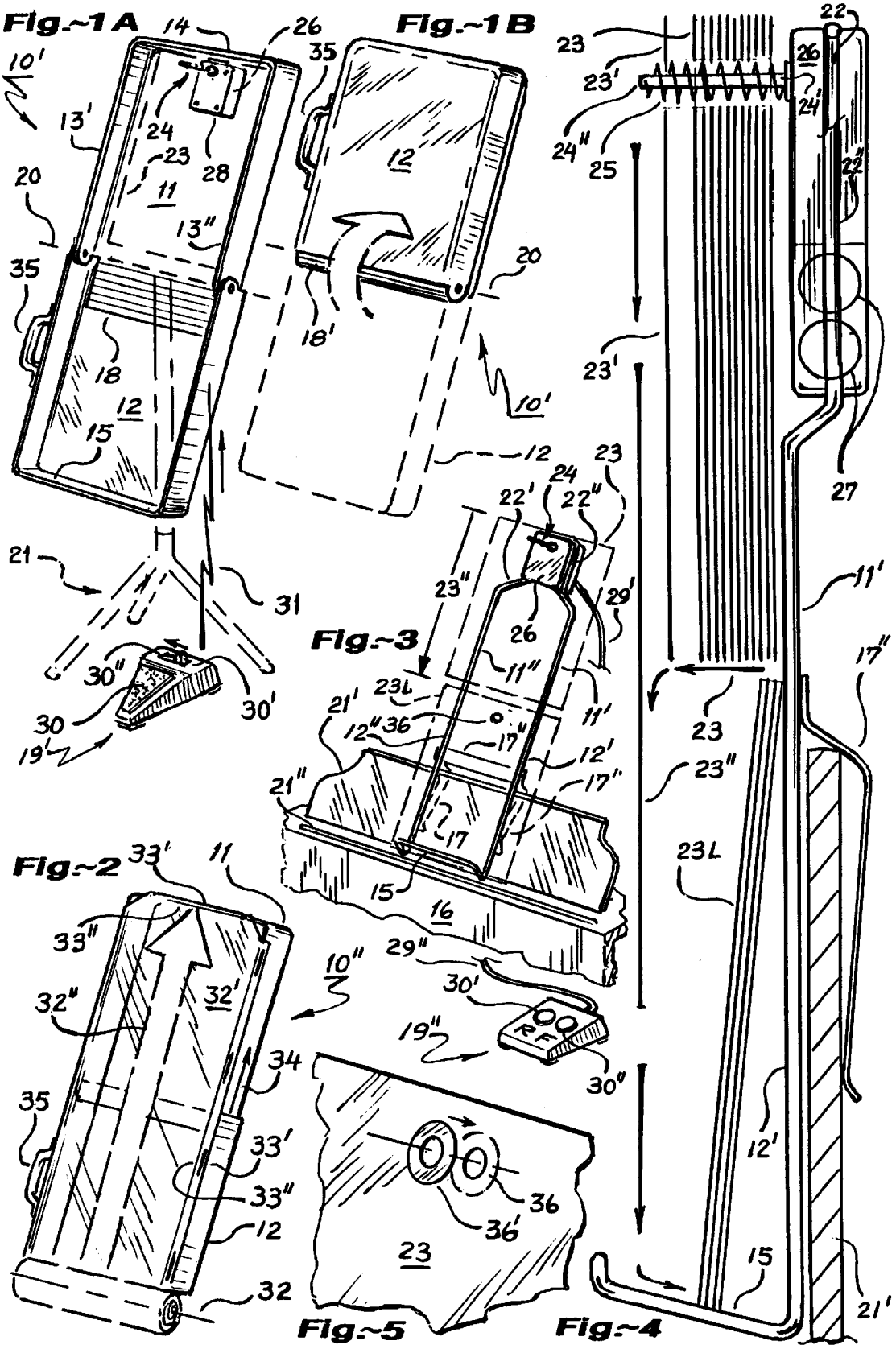
FIG. 1A, is a pictorial perspective-view, favoring the frontal upper-right portion of an exemplified foldable-case embodiment of the orchestra version of the invention.
FIG. 1B, is an alternate view thereof, showing how the invention appears once compactly folded.
FIG. 2, is an alternate view of an embodiment similar to that of FIG. 1A, excepting that a telescopic generic-variant is shown, plus a flexible transparent plastic cover has been adapted to ward off effects of inclement weather.
FIG. 3, is a pictorial view of the invention, as adapted to use upon the music-rack of an existing piano or organ, and demonstrates the sequence of conveying pages from initial hanging to landing upon the page receiver-support via the action ref.-arrow.
FIG. 4, is an enlarged diagrammatic right-side full elevation-view of the invention according to FIG. 3 depiction.
FIG. 5, is an enlarged albeit fragmented detail view showing the optional conventional reinforced-grommet in accordance with FIG. 3 perspective.

10'/10"—overall portable housing (folding/sliding)
11, 11'/11"—back-support tray, equivalent wire-guides (left/right portions)
12, 12'/12"—receiver-support tray, equivalent wire-guides (left/right-portions)
13'/13"—sidewalls (left/right)
14—top-wall
15—bottom-wall (also page-rest)
16—piano facia-board
17'/17"—spring-clip (left/right)
18—flexile-panel (open/closed)
19'/19"—remote phasing-switch (RF-type/hard-wired type)
20, 20'/20"—hinge-axis, pivot-rivets (left/right)
21,21'/21"—existing music-stand, existing back/rest (piano)
22,22'/22"—housing mounting-channel, uppermost bentwire-bracket (left/right-portions)
23/23'/23"/23L—page staging (ready/feeding/falling/landed)
24,24'/24"—conveyer-spindle, shaft portion/nose portion
25—screw-threads (helicals)
26—motor-housing
27—batteries
28—mounting-screws
29'/29"—remote-conduit (upper-lead/lower-lead)
30,30'/30"—control-switch momentary-button, switch (forward/reverse)
31—RF-signal (symbol)
32/32',32"—transparent-cover (coiled-roll/deployed), ref.-action arrow
33'&33"—cover strip-fastener (hook & loop portions)
34—telescopic sliding (ref.-action arrow)
35—carry-handle
36,36'—reinforcement-grommet, hanger-hole

V.) DETAILED DESCRIPTION OF THE PREFERRED EMBODIMENTS:

Initial reference is given by way of FIGS. 1A & 1B, wherein is exhibited the overall portable housing version of my PAGEMINDER™ invention, in this iteration comprising a preferably transparent-plastic assembly 10', which is constructed of an upper-shell 11 and a bottom-shell portion 12 which include substantially contiguous sidewalls 13' and 13" preferably formed with a top-wall portion 14 and a bottom-wall portion 15; all of which essentially serving in support of motor-housing 26 via conventional mounting screw-fasteners 28. Here the side-walls include pivot-rivets 20' and 20" creating a hinge-axis 20, enabling the user to fold the assembly compactly in half (FIG. 1B) for easier carrying by carry-handle 35, and easy stowing. Note also how the carry-case modality of FIG. 1B is facilitated via an integrally molded transversely scored (creating weakened flex points) flexile-panel 18, which assumes a flat configuration upon opening of the case into the undivided elongate housing of FIG. 1A; thereby allowing the sheetmusic (musician's music-score or orator's text-pages) to fall via gravity to land smoothly unimpeded upon the bottom-wall or bottom-rest 15 (as shall be shown).

Music-scores or text may be somewhat sized irregularly smaller or larger dimensionally, and a photocopy-machine using 24-lb (gauge ref.) paper-sheets is generally employed to transfer page-images (musical-scores usually imprinted upon both sides of the page) on to only a single side of each page for implementation into simplified my system of vertical page transfer (not lateral page-turning). The user has no concern nor restriction to playing only certain music-scores, because it's particular original format size (page length & width) could not be accommodated by the page-turner apparatus. Hence, the term "universal" is appropriate,—in that it characterizes the advantageous nature of the instant invention being set forth herein.

There remain subtle, however vital other features which are to become herein more evident and understood as important improvements. For example, FIG. 2 suggests how an alternate telescopicly retractable casement 10" slides extendably out to also be conveniently supported by an existing music-stand (see FIG. 1), that the casement is still thus preferably comprised of two major portions, the source-tray 11 and receiver-tray 12. Also shown here is an approximate 0.060-inch thickness-gage transparent vinyl cover which is shown rolled into a compact coil 32, that can be readily deployed according to ref.-arrow 32" into fully deployed condition 32'; at which position the cover is secured via a plurality of quickly avusable hook 33' and loop 33" strip-fasteners (VELCRO®).

Reference to FIG. 3 shows how the same technique is adapted to installation of the invention upon an existing piano (or organ) music-backrest structure 21' and 21", for example by provision of a special heavy-guage bent brass-wire bracket having left 22' and right 22 upper portion elements, which are preferably formed to fit intimately around a receiving mounting-channel 22 (FIG. 4); thereby suspending the motor-housing securely fixed at an uppermost position 26. The wire framework assembly also preferably includes a bottom-rest or receiver-support 15, and is conveniently installed in place via assistance of a bifurcated spring-clips 17 and 17' which are joined to the two spaced-apart vertical wire-rod elements 17/17' via a brass cross-brace 17". Delux versions can be given an attractive cosmetic brass filigree panel (not shown) filling in the entire vertical space spanning between the vertical wire-rods 17/17'.

Study of FIGS. 4 especially reveals the novel spindle-conveyer page-handling technique employed in this invention, and facilitated by the special helical-conveyer device comprising a nose 24" terminating spindle-shaft 24' having screw-threads 25 normally rotated (here clockwise) via a conventional motor (within housing 26) preferably electrically energized via small possibly AA-size batteries 27. To convey the manually installed intimately clustered (stacked) pages at stage 23, the operator in FIG. 1 iteration simply touches the preferably remotely actuated control-module 19' and 19" of a momentary type selector button 30 in combination with a separate forward 30' or reverse 30" switching arrangement (well known in the art); which command is wirelessly conveyed to the motor-housing 26 via a commercially available RF (radio-frequency)-transmitter (related to stateof-the-art wireless remote doorbell units) contained within the foot-actuated unit 19'. In contrast, the remote-control unit 19" example of FIG. 3, employs a more conventional hard-wired electrical conductor conduit 29'/29"; wherein the remote module 19" enables preferred foot-actuation of momentary-switch selector-button 30" for forward-rotation of the entire spindle-conveyor 24. Although either a timer or RPM regulator may also be adapted hereto, it is presently preferred that the musician/orator user simply release pressure upon the momentary-button by way of determining their own personal rate of page-sequencing. Looking at FIG. 4, a single-page 23' is shown conveyed poised proximally the spindle-shaft nose 24", while page 23" (also indicated via ref.-arrow action in FIG. 3) is shown falling via gravity to finally land 23L upon the receiver-support ledge 15 where it is observed by the reader.

Once the spindle-conveyor suspended pages 23 have been conveyed into a cluster 23L it is found that they are then numbered in their opposite order of viewed sequence; thus the operator can obtain a recollating back into their original collated order by simply manually replacing the aggregate pages back upon the conveyer-spindle 24 while preferably depressing the reverse-rotation selector-button 30' to assist the loading of the respective hanger-holes 36 as far as they will compact upon the spindle-shaft 24, whereupon forward-rotation is again (continuously now) activated via selector-button 30" until all of the pages have again transulated down upon the receiver-support 15. The pages are now restored to their original order of sequence, and are finally manually replaced upon the spindle-conveyer 24 if subsequent performance readiness is desired.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A universal page-changing apparatus facilitating sequential reading of printed matter by musician or orator; said apparatus comprising:

a energizing means with an on/off switch, driving a motor turning a helical conveyor-spindle feeding device cantilevering perpendicularly from a back-support means and approximately horizontal to the ground-plane; whereby a plurality of loose-leaf pages each having a hanger-hole arranged centrally into its header-margin are thereby hung together dependently from said spindle-conveyor, so as to be thereby sequentially released from said conveyer-spindle upon switching-on said motor into forwardly conveying motion of said conveyor-spindle, said helical thereby causing said pages to successively gravitate into an intimate cluster therebelow.

2. The page-changer apparatus according to claim 1, wherein said back-support is a rigid bracket extending up from an existing keyboard music-backrest, whereto said spindle-conveyer is thereby spaced sufficiently upward therefrom as to enable each dependently said hanging page to drop separately downward upon a sheetmusic-rest means therebelow, whereto each successive said page can be read by the keyboard-player at said music-backrest normal reading height.

3. The page-changer apparatus according to claim 2, wherein said bracket includes a clamping means of securing to said music-backrest without intrusion into the space where the pages said cluster therebelow.

4. The page-changer apparatus according to claim 1, wherein said back-support means includes a guide-surface means extending contiguously up from a receiver-support means having a bottom-rest means above which said spindle-conveyer is spaced apart sufficiently to enable each successive said page to drop freely down into said cluster.

5. The page-changer apparatus according to claim 4, wherein aggregate said back-support and receiver-support portions include a conventional musicstand; whereby the user observes at a conventional reading height from the formost said conveyer-spindle hanging page.

6. The page-changer apparatus according to claim 1, wherein said on/off switch is a conventional normally-open momentary type electrical-switch.

7. The page-changer apparatus according to claim 1, wherein said motor is a conventional battery powered electric-motor having a drive ratio-reduction means, thereby capable of turning said conveyer-spindle at a slower rate than said electric-motor's rate of rotation.

8. The page-changer apparatus according to claim 1, wherein said on/off switch is a conventional normally-closed mechanical interference type switch, such as is employed by music-box devices.

9. The page-changer apparatus according to claim 1, wherein said motor is a conventional wind-up spring powered clock-work mechanism such as is commonly employed in music-boxes including a drive having a ratio-reduction means, and thereby turn said conveyer-spindle at a slower rate than said motor's rate of rotation.

10. The page-changer apparatus according to claim 1, wherein said hanger-hole is installed by a conventional manually actuated hole-punch tool built-in to said back-support; thereby being conveniently available at any time for modifying any single page for use with said conveyor-spindle.

11. The page-changer apparatus according to claim 1, wherein said hanger-hole is installed by a conventional commercially available manually actuated hole-punch hand-tool.

12. A universal page-changing apparatus facilitating sequential reading of printed matter by musician or orator; said apparatus comprising:

a normally-open electric-switch controlling current from a battery driving an electric-motor turning a helical conveyor-spindle device projecting perpendicularly toward the user from a back-support means and approximately horizontal to the ground-plane toward the user; whereby two or more loose-leaf pages each having a hanger-hole arranged centrally into its header-margin are thereby hung together upon said spindle-conveyor, so as to be thereby sequentially released from said conveyer-spindle upon forward rotation of said screw-thread, causing each said page to gravitate into an intimate cluster therebelow.

13. The page-changer apparatus according to claim 12, wherein said back-support is a rigid bracket extending up from an existing keyboard music-backrest, whereto said conveyer-spindle is thereby spaced sufficiently upward therefrom as to enable each dependently said hanging page to drop separately downward upon a sheetmusic-rest means therebelow, whereto each successive said page can be read by the keyboard-player at said music-backrest normal reading height.

14. The page-changer apparatus according to claim 12, wherein said bracket includes a clamping means of securing to said music-backrest without intrusion into the space where the pages said cluster therebelow.

15. The page-changer apparatus according to claim 12, wherein said back-support means includes a guide-surface means extending contiguously up from a receiver means having a right-angle flange like bottom-rest means above which said conveyer-spindle is spaced above sufficiently enabling each said successive said page to drop freely down into said cluster.

16. The page-changer apparatus according to claim 15, wherein said guide-surface includes an uppermost right-angle flange plus left and right sidewalls and is a contiguous planar extension of a planar surface defined by said receiver also including contiguous left and right sidewalls.

17. The page-changer apparatus according to claim 16, wherein is included a flexible transparent plastic readily detachable cover means spanning top to bottom across between said sidewalls as a windbreak means; thereby preventing wind-blown disruption of said page changing operation therewithin during windy or rainy conditions.

18. The page-changer apparatus according to claim 15, wherein is included a horizontal hinge-axis means at the offset intersection of said guide-surface sidewalls and said receiver sidewalls; thereby enabling said guide-surface portion and said receiver portion to hingably fold together compactly in half.

19. The page-changer apparatus according to claim 12, wherein said electric-switch is provided with a circuit extension means, whereby said page-changing operation can be sequenced remotely via foot operation.

20. A universal page-changing method comprising the steps of:

providing an energizing means having an on/off-switch, driving a motor turning a screw-threaded conveyor-spindle device projecting perpendicularly from a back-support means and approximately horizontal to the ground-plane toward the user;

placing a plurality of loose-leaf pages each provided with a hanger-hole arranged centrally into its header-margin hung together as a stack upon said conveyor-spindle, as to be thereby sequentially released from said spindle-conveyer upon forward rotation of said screw-thread, causing each said page to gravitate into an intimate cluster therebelow with each successive page falling in front of the previously dropped page.

* * * * *